US007246688B2

(12) United States Patent
Tonna et al.

(10) Patent No.: US 7,246,688 B2
(45) **Date of Patent: *Jul. 24, 2007**

(54) ELEVATOR DOOR SYSTEM

(75) Inventors: Christian G. Tonna, Acheres (FR); Helmut Schröder-Brumloop, Berlin (DE); Christoph Durand, Poilly les Gien (FR)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 09/220,462

(22) Filed: Dec. 23, 1998

(65) Prior Publication Data

US 2002/0003065 A1 Jan. 10, 2002

(51) Int. Cl.
*B66B 13/06* (2006.01)

(52) U.S. Cl. ..... 187/324; 49/360

(58) Field of Classification Search ..... 187/324, 187/334, 315, 313; 49/360
See application file for complete search history.

(56) References Cited

U.S. PATENT DOCUMENTS

| | | | | | |
|---|---|---|---|---|---|
| 1,071,309 | A | | 8/1913 | Goggin | |
| 3,101,130 | A | | 8/1963 | Bianca | |
| 4,149,615 | A | * | 4/1979 | Kappenhagen | 187/324 |
| 4,359,143 | A | * | 11/1982 | Jackson | 187/324 |
| 4,593,793 | A | | 6/1986 | Salmon | 187/56 |
| 4,884,844 | A | * | 12/1989 | Kershaw et al. | 297/362 |
| 4,949,815 | A | | 8/1990 | Pavoz | 187/20 |
| 5,213,182 | A | * | 5/1993 | Guckert et al. | 187/315 |
| 5,429,211 | A | | 7/1995 | Aulanko et al. | 187/254 |
| 5,435,417 | A | | 7/1995 | Hakala | 187/404 |
| 5,469,937 | A | | 11/1995 | Hakala et al. | 187/266 |
| 5,490,578 | A | | 2/1996 | Aulanko et al. | 187/254 |
| 5,566,785 | A | * | 10/1996 | Hakala | 187/250 |
| 5,659,160 | A | | 8/1997 | Tracey | |
| 5,665,944 | A | * | 9/1997 | Aulanko et al. | 187/277 |
| 5,701,973 | A | | 12/1997 | Tracey | 187/316 |
| 5,711,112 | A | | 1/1998 | Barten et al. | 49/118 |
| 5,797,471 | A | * | 8/1998 | Princell | 187/324 |
| 5,837,948 | A | * | 11/1998 | Aulanko et al. | 187/277 |

(Continued)

FOREIGN PATENT DOCUMENTS

AU 1 032 496 6/1958

(Continued)

OTHER PUBLICATIONS

"Elevator Mechanical Design, Principles and Concepts", by Lubomir Janovsky, Ellis Horwood Limited (1987).

(Continued)

*Primary Examiner*—Andrew Joseph Rudy

(57) ABSTRACT

An elevator door system includes an elevator car having a front face defining a door opening. At least one elevator door is coupled to the front face of the elevator car for movement between an open position exposing the door opening and a closed position covering the door opening. At least one drive motor is mounted on the front face of the elevator car and is disposed between a lower edge and an upper edge of the elevator car. The drive motor is drivingly coupled to the elevator door for moving the elevator door between the open and the closed positions.

21 Claims, 11 Drawing Sheets

U.S. PATENT DOCUMENTS

| | | | | |
|---|---|---|---|---|
| 5,852,897 | A | 12/1998 | Sukale | 49/358 |
| 5,878,846 | A * | 3/1999 | O'Donnell | 187/318 |
| 6,252,317 | B1 * | 6/2001 | Scheffer et al. | 310/46 |
| 2001/0047909 | A1 * | 12/2001 | Mollenauer et al. | 187/324 |

FOREIGN PATENT DOCUMENTS

| | | | | |
|---|---|---|---|---|
| DE | 296 15 921 | U1 | 4/1997 | |
| EP | 0 606 875 | A1 | 1/1994 | |
| EP | 0 779 233 | A2 | 6/1994 | |
| EP | 0 784 030 | A2 | 6/1994 | |
| EP | 0 688 735 | A2 | 6/1995 | |
| EP | 0 710 618 | A2 | 10/1995 | |
| EP | 0 749 930 | A2 | 6/1996 | |
| EP | 0 749 931 | A2 | 6/1996 | |
| FR | 2 640 604 | | 12/1988 | |
| GB | 2 138 397 | B | 11/1985 | |
| GB | 2 2-1 657 | B | 8/1990 | |
| JP | 57119654 | * | 7/1982 | |
| JP | 1-242386 | | 9/1989 | |
| JP | 402081888 | * | 3/1990 | 187/324 |
| JP | HEI 2-81888 | | 3/1990 | |
| JP | 402169487 | * | 6/1990 | 187/334 |
| JP | 403211184 | A * | 9/1991 | 187/315 |
| JP | 403264486 | A * | 11/1991 | 187/315 |
| JP | 404248347 | * | 9/1992 | 310/67 R |
| JP | 404350089 | A * | 12/1992 | 187/315 |
| JP | 05118726 | | 5/1993 | |
| JP | 4-06329375 | * | 11/1994 | |
| JP | HEI 6-329375 | | 11/1994 | |
| JP | 409125822 | * | 5/1997 | |
| WO | 093023324 | * | 11/1993 | 187/324 |
| WO | WO 96/09978 | | 4/1996 | |
| WO | WO 98/29326 | | 7/1998 | |
| WO | WO 98/29327 | | 7/1998 | |

OTHER PUBLICATIONS

PCT Search Report for Ser. No. PCT/US99/22298 dated Feb. 18, 2000.

PCT Search Report for Ser. No.PCT/US99/30052 dated Apr. 20, 2000.

* cited by examiner

ELEVATOR DOOR SYSTEM

FIELD OF THE INVENTION

The present invention relates generally to an elevator system, and more particularly to an elevator door system including a drive motor coupled to an elevator car and disposed below the ceiling of the elevator car.

BACKGROUND OF THE INVENTION

Considerable expense is involved in the construction of an elevator hoistway and machine room. The expense includes the cost of constructing the machine room, the structure required to support the weight of the machine room and elevator equipment, and the cost of shading adjacent properties from sunlight (e.g., sunshine laws in Japan and elsewhere). The expense also includes the length of the hoistway. Typically, local codes require a minimum clearance between the top of the elevator car at its highest position in the hoistway and the hoistway ceiling. Conventionally, the highest item on top of the elevator car is the door operator which is located on top of or projects partly above the elevator car ceiling. By eliminating or minimizing the highest points on top of the elevator car, the length of the hoistway may be reduced so as to result in a significant reduction in construction costs.

One solution is to move the door operator underneath the elevator car. However, this approach only results in shifting the clearance problem since additional space is required in the lower portion of the hoistway to accommodate the door operator. Another solution is to move the door operator to a side of the elevator car. A drawback with placing the door system on a side of the car is that additional space between the car and hoistway sidewall is necessary to accommodate rather bulky, conventional motors which drive the elevator car and hoistway doors. Thus the additional side space required to accommodate the drive system detracts from any savings due to reducing the overhead space of the hoistway.

It is an object of the present invention to provide an elevator door system which avoids the above-mentioned drawbacks associated with prior elevator door systems.

SUMMARY OF THE INVENTION

According to an aspect of the present invention, an elevator door system includes an elevator car having a front face defining a door opening. At least one elevator door is coupled to the front face of the elevator car for movement between an open position exposing the door opening and a closed position covering the door opening. At least one drive motor is mounted on the front face of the elevator car and is disposed between a lower edge and an upper edge of the elevator car. The drive motor is drivingly coupled to the elevator door for moving the elevator door between the open and the closed positions.

According to another aspect of the present invention, an elevator door system includes an elevator car having a front face defining a door opening. At least one elevator door is coupled to the front face of the elevator car for movement between an open position exposing the door opening and a closed position covering the door opening. At least one flat drive motor is mounted on the front face of the elevator car and is drivingly coupled to the elevator door for moving the elevator door between the open and the closed positions. The flat drive motor is preferably a pancake motor having an external rotor serving as a sheave or roller.

A first advantage of the present invention is that the elevator system reduces the required reserved space between the top of the elevator car and the ceiling of the hoistway or the space between a bottom of the car and the floor.

A second advantage of the present invention is that the hoistway does not require additional space to accommodate the drive motor between the elevator car and a sidewall of the hoistway.

Additional advantages of the present invention will be made apparent in the detailed description and accompanying drawings.

DETAILED DESCRIPTION OF THE PREFERRED EMBODIMENTS

Figure 1:
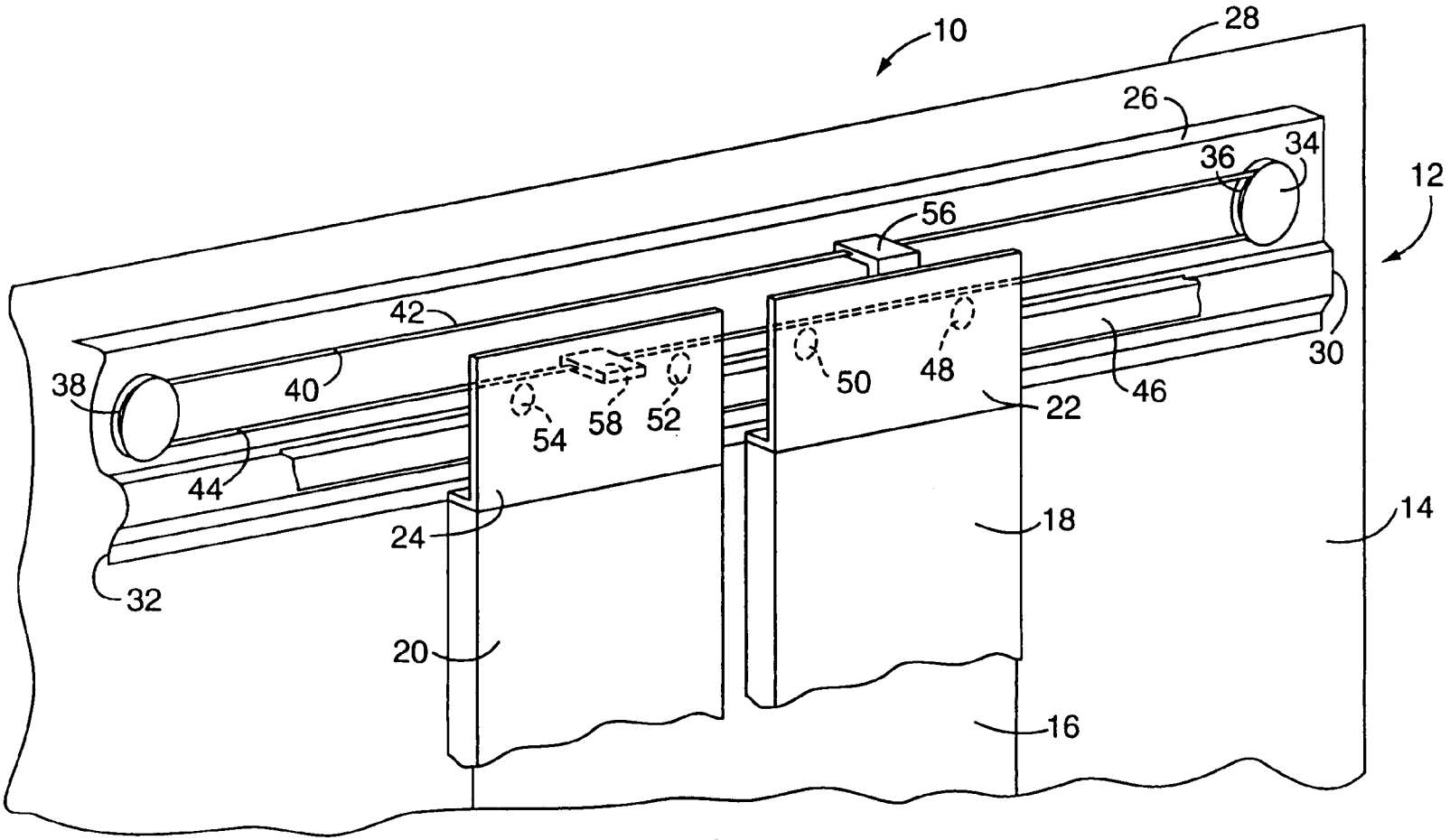
FIG. 1 is a schematic, perspective view of an elevator door system embodying the present invention.
Figure 2:
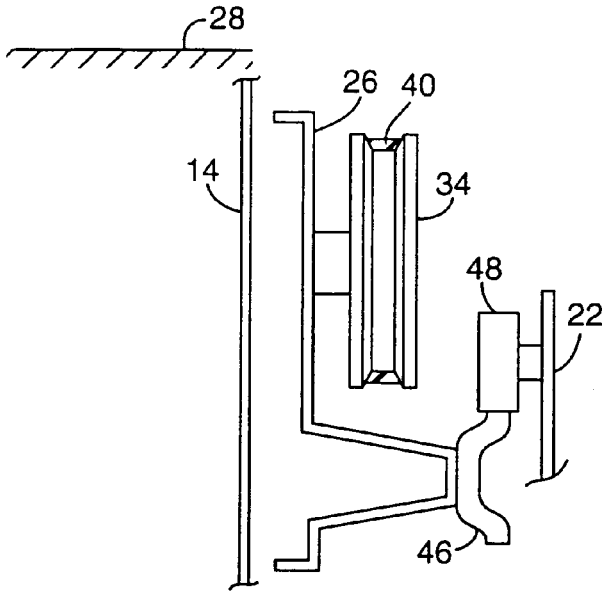
FIG. 2 is a schematic, side elevational view of the header bracket OF FIG. 1.

With reference to FIGS. 1 and 2, an elevator door system embodying the present invention is generally designated by the reference number 10. The door system 10 includes an elevator car 12 (shown in part) having a front portion including a front face 14 defining a door opening 16. The front portion of the elevator car 12 further includes first and second doors 18, 20 which respectively include first and second hangers 22, 24 projecting upwardly from a body of the doors for mounting the doors to the elevator car 12 over the door opening 16. As shown in FIG. 1, the hangers 22, 24 when mounted on the elevator car 12 are spaced frontwardly of the front face 14.

A header bracket 26 is mounted on the front face 14 of the elevator car 12 below an upper edge or ceiling 28 of the car and above the door opening 16. As shown in FIG. 1, the header bracket 26 preferably extends generally from a first side 30 to a second side 32 of the elevator car 12. A drive motor 34 including an integrated first sheave 36 for moving the doors 18, 20 is mounted on the header bracket 26 adjacent to the first side 30 of the car 12. Preferably, the drive motor 34 is a flat motor, such as a pancake permanent magnet motor having its rotor serving as the sheave (i.e., an external rotor permanent magnet motor), or may be any other low-profile motor disposed frontwardly of the front face 14 of the car 12 between the header bracket 26 and the hangers 22, 24 of the respective elevator car doors 18, 20. The drive motor 34 may alternatively be disposed on the front face 14 at any other suitable location between the upper edge or ceiling 28 and a lower edge or floor (not shown) of the elevator car 12, whereby the drive motor does not intrude into the hoistway space above or below the car, and does not intrude into the side space between the elevator car doors 18, 20 and an opposing sidewall of the hoistway.

A second sheave 38 is mounted on the header bracket 26 adjacent to the second side 32 of the car 12. The second sheave 38 may be passively rotated by the first drive motor 34 via a rope 40 rotatably coupling the second sheave 38 to the first sheave 36, or in addition, be rotated by a second drive motor integrated with the second sheave 38. A second drive motor may be necessary for moving heavy doors or be desirable for decreasing the length of time for opening and closing the doors. The second sheave 38 is flat in profile, and a drive motor when integrated with the second sheave 38 is preferably a flat motor, such as a pancake permanent magnet motor having its rotor serving as the sheave, or may be any other low-profile motor disposed frontwardly of the front face 14 of the car 12 between the header bracket 26 and the hangers 22, 24 of the respective elevator car doors 18, 20. The rope 40, which may be round or generally flat, is coupled to the first sheave 36 and the second sheave 38 so as to form a closed-loop for transferring the rotational motion of the sheaves 36, 38 into linear motion of the doors 18, 20. The rope 40 extends along an upper portion 42 from the first sheave 36 to the second sheave 38, arcs about the second sheave 38, extends along a lower portion 44 from the second sheave 38 to the first sheave 36, and arcs about the first sheave 36 to complete the closed-loop.

As shown in FIGS. 1 and 2, a roller track 46 coupled to or formed integrally with the header bracket 26 extends generally along a length of the header bracket. At least one roller is attached to each of the first and second hangers 22, 24 of the respective first and second doors 18, 20 and rotatably engages the roller track 46 to support the doors and facilitate movement of the doors therealong. As shown in FIG. 1, for example, first and second rollers 48 and 50 are attached to the first hanger 22 of the first door 18, and third and fourth rollers 52, 54 are attached to the second hanger 24 of the second door 20.

The system 10 includes means for attaching the first and second doors 18, 20 to the rope 40. For example, the attaching means includes a first bracket or fixation 56 fixedly coupled to the first hanger 22 and to the upper portion 42 of the closed-loop formed by the rope 40, and a second bracket or fixation 58 fixedly coupled to the second hanger 24 and to the lower portion 44 of the closed-loop formed by the rope. Because the elevator door system 10 is located within the header bracket 26, the elevator door system 10 eliminates additional mechanical linkages and sheaves needed when the drive system is located either above or below the car so as to lower construction costs and increase power efficiency to the elevator door system.

In operation, as the first drive motor 34 (and the second drive motor if applicable) is activated by an elevator door system controller (not shown) to open the doors 18, 20, the first and second sheaves 36, 38 are caused to rotate clockwise, whereby the first and second doors 18, 20 move away from each other to expose the door opening 16 and allow passengers to enter and exit the car 12. When the first drive motor 34 (and the second drive motor if applicable) is activated by the elevator door system controller to close the doors 18, 20, the first and second sheaves 36, 38, are caused to rotate counterclockwise, whereby the first and second doors 18, 20 move toward each other to cover the door opening 16 when the elevator car 12 is unoccupied or prior to movement of the car along the hoistway.

As can be seen in FIG. 1, since the door system 10, including the drive motor(s) is located on the front face 14 of the elevator car 12 below the top and bottom edges of the car, the elevator door system is not the highest or lowest part of the car, and therefore does not require the length of the hoistway to be increased in order to accommodate the door system. Further, the door system 10, including the drive motor(s) are not disposed between the elevator car doors 18, 20 and an opposing sidewall of the hoistway, and therefore does not require a width of the hoistway to be increased in order to accommodate the door system. It should be understood that disposing the elevator door system between the top and bottom edges of the car, and employing low-profile motors is not limited to the center opening, two-door system shown in FIGS. 1 and 2, but may be used in other types of door systems such as telescopic or single slide door systems.

Figure 3:
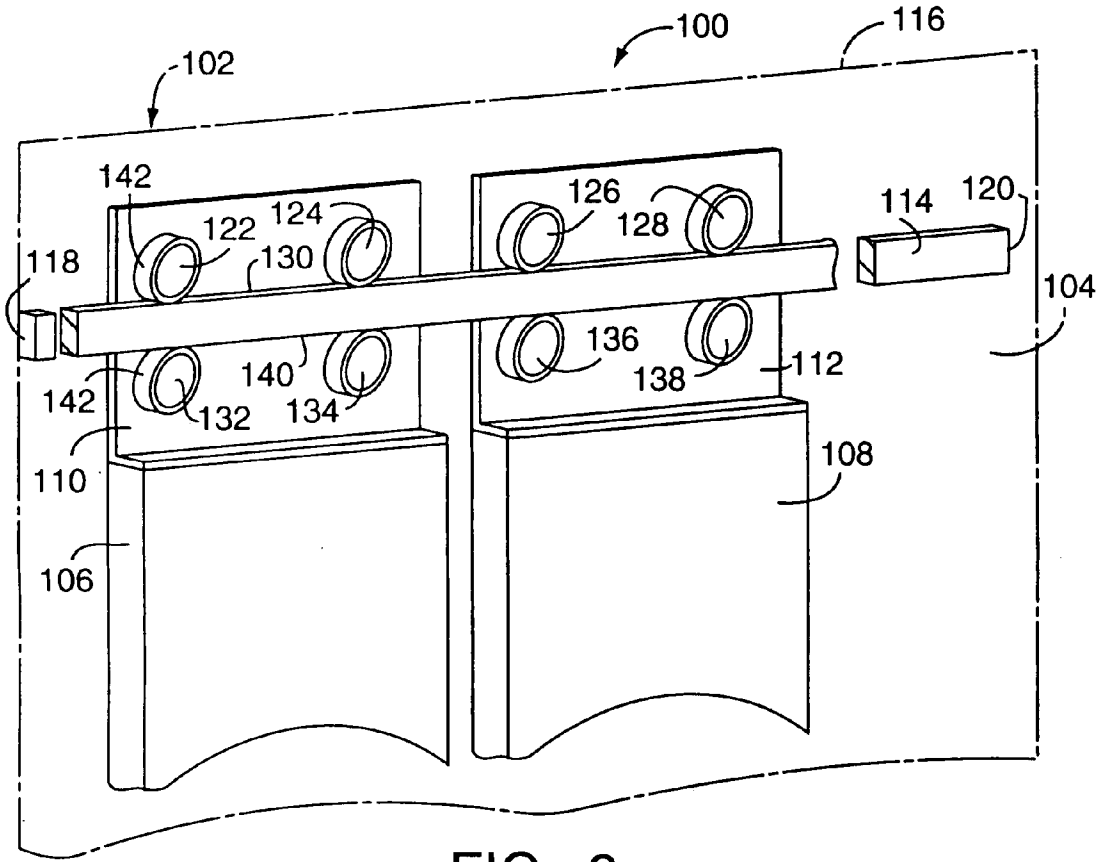
FIG. 3 is a schematic, perspective view of an elevator door system in accordance with a second embodiment of the present invention.

Turning now to FIG. 3, an elevator door system in accordance with a second embodiment of the present invention is generally designated by the reference number 100. For simplicity of illustration, the system 100 does not show the pulley system for assisting in the movement of the elevator doors, such as, for example, the pulley system of FIG. 1 which includes the first and second sheaves 36, 38, the fixations 56, 58 and the rope 40.

The door system includes an elevator car 102 (shown in part) having a front face 104 defining a door opening (not shown). First and second doors 106, 108 respectively include first and second hangers 110, 112 projecting upwardly from a body of the doors for mounting the doors to the elevator car 102 over the door opening. As shown in FIG. 3, the hangers 110, 112 when mounted on the elevator car 102 are spaced frontwardly of the front face 104.

An elongated member or roller track 114 is mounted on either a header bracket or directly to the front face 104 of the elevator car 102 below an upper edge or ceiling 116 of the car and above the door opening. As shown in FIG. 3, the roller track 114 preferably extends generally from a first side 118 to a second side 120 of the elevator car 102. First and second rollers 122, 124 are attached to the first hanger 110, and third and fourth rollers 126, 128 are attached to the second hanger 112. The rollers 122–128 rotatably engage a top edge 130 of the roller track 114 for assisting the pulley system in moving the elevator doors from an open position to a closed position. The elevator door system 100 preferably further includes first and second up-thrust, counter-rollers 132, 134 attached to the first hanger 110, and third and fourth up-thrust, counter-rollers 136, 138 attached to the second hanger 112. The counter-rollers 132–138 are biased upwardly against and rotatably engage a bottom edge 140 of the roller track 114 for aiding the rollers 122–128 in providing smooth elevator door movement. Preferably, the counter-rollers 132–138 are spring loaded to create the upward bias against the bottom edge 140 of the roller track 114. The rollers 122–128 and the counter-rollers 132–138 preferably have a durable, high traction material, such as tires 142, 142 disposed about the circumference of the rollers for increasing the friction between the rollers and the roller track 114.

At least one of the rollers 122–128 is a motor roller, and is preferably an external rotor permanent magnet motor upon which the outside rim of the rotor receives the tire 142. The number of rollers which are motor rollers may increase for enhanced performance and reliability of the elevator door system 100. Several motor rollers may be desired for faster door movement, redundancy considerations, heavy-duty doors, or for a three or higher door drive system. In a low range door system, for example, the second roller 124 may be a motor roller and the remaining rollers 122, 126 and 128 are passive or standard rollers. In a mid range door system, for example, the second door roller 124 and the third door roller 126 may be a motor roller and the remaining rollers 122 and 128 are passive or standard rollers. In a high range door system, for example, the rollers 122–128 may all be motor rollers. In a super high range door system, for example, the counter-rollers 132–138 may be motorized in addition to the rollers 122–128. A low range system driven by one motor roller is typically suitable for a two door system, such as the center door system illustrated in FIG. 3. A mid range door system is typically suitable for a three or four door drive system, and a high range door system is typically suitable for a four door drive. It should be understood that disposing the elevator door system between the top and bottom edges of the car, and employing low-profile motor rollers is not limited to the center opening, two-door system shown in FIG. 3, but may be used in other types of door systems such as telescopic or single slide door systems.

An advantage of the present invention as embodied in FIG. 3 is that one motor design is generally sufficient to cover the full range of door systems. For example, a 50 Watt motor roller is generally sufficient for powering a low range door system. Two 50 Watt motor rollers provides 100 Watts which is generally sufficient to power a mid range door system, and four 50 Watt motor rollers provides 200 Watts which is generally sufficient to power a high range door system.

A second advantage of the present invention as embodied in FIG. 3 is that (except for a low range door system employing only one motor roller) a single failure of a motor roller will not result in a shut down of the elevator resulting in inconvenience to the elevator users, but will only result in running the elevator door system with degraded performance until the faulty motor roller is replaced. Even low range door systems may enjoy this advantage if two motor rollers at half power (i.e., 25 Watts each) are substituted for the single, 50 Watt motor roller.

A third advantage of the present invention is that the elevator door system is easily accessible from the elevator door landing, and part replacement is as easy as replacing a hanger roller.

A fourth advantage of the present invention is that an elevator door system may be easily modernized or modified by replacing a standard roller with a motor roller or by replacing a hanger equipped with standard rollers with a new door hanger equipped with motor rollers.

Figure 4:
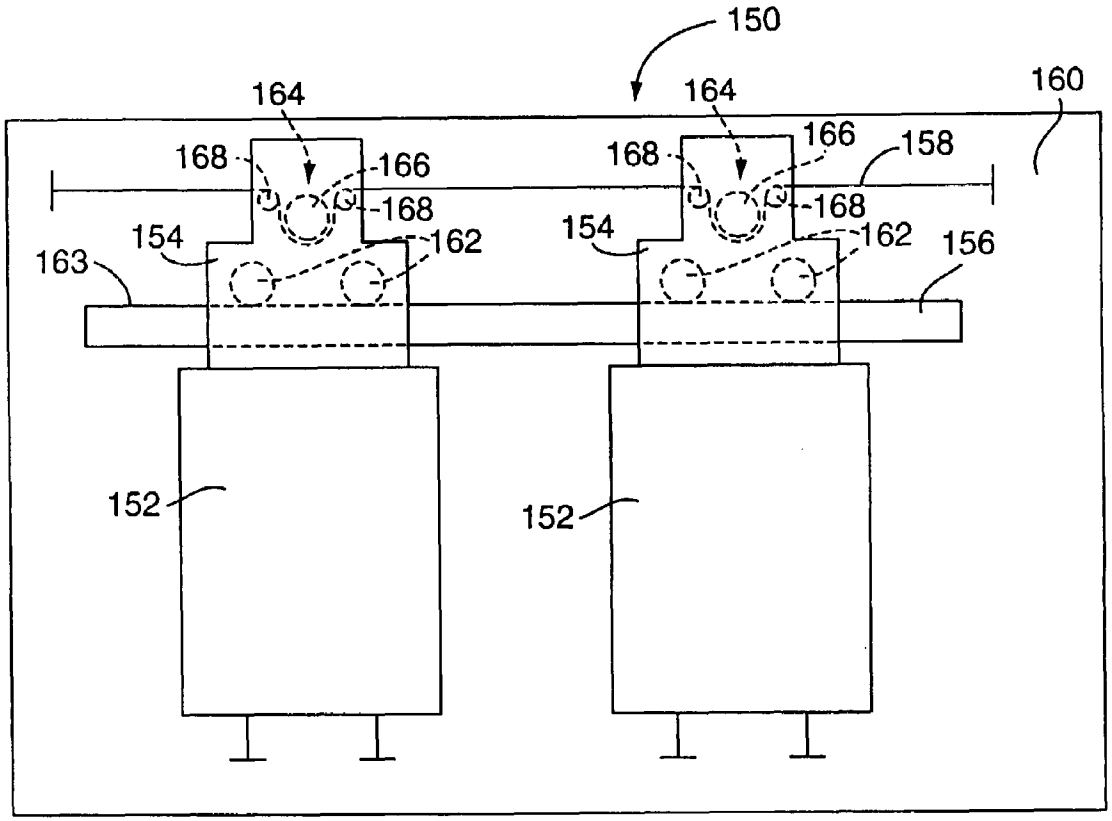
FIG. 4 is a schematic, front elevational view of an elevator system in accordance with a third embodiment of the present invention.

Turning now to FIG. 4, an elevator door system in accordance with a third embodiment of the present invention is generally designated by the reference number 150. The elevator door system 150 includes at least one door having a hanger, such as the two doors 152, 152 with hangers 154, 154 shown in FIG. 4. A roller track 156 and a length of rope 158 fixed at each end are disposed above the roller track extend along a front face 160 of an elevator car. At least one track roller, such as two track rollers 162, 162, are coupled to the hanger 154 of each door 152 and rotatably engage an upper surface 163 of the roller track to support the door and to facilitate movement of the door between its open and closed positions. Further, a flat, drive motor 164 including a traction sheave 166 and at least one deflector roller, such as the two deflector rollers 168, 168, are coupled to the hanger 154 of each door, and rotatably engage the fixed rope 158. In operation, as each drive motor 164 is actuated and rotates its associated traction sheave 166, the traction between the traction sheave and the rope 158 causes the traction sheave, and in turn the door 152, to move along the length of the rope toward either an open or closed position.

Figure 6:
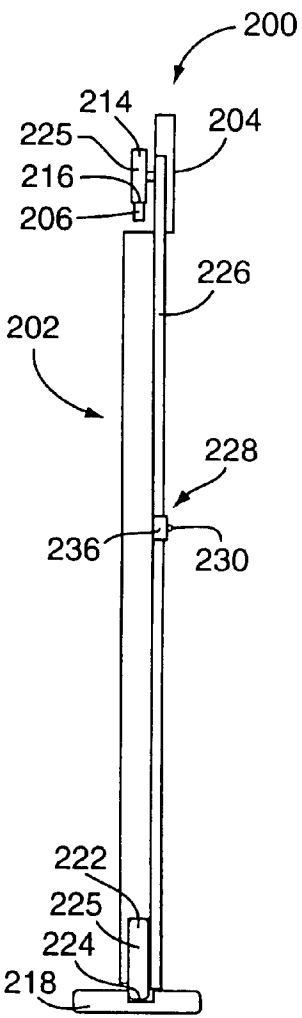
FIG. 6 is a side elevational view of the elevator system of FIG. 5.
Figure 5:
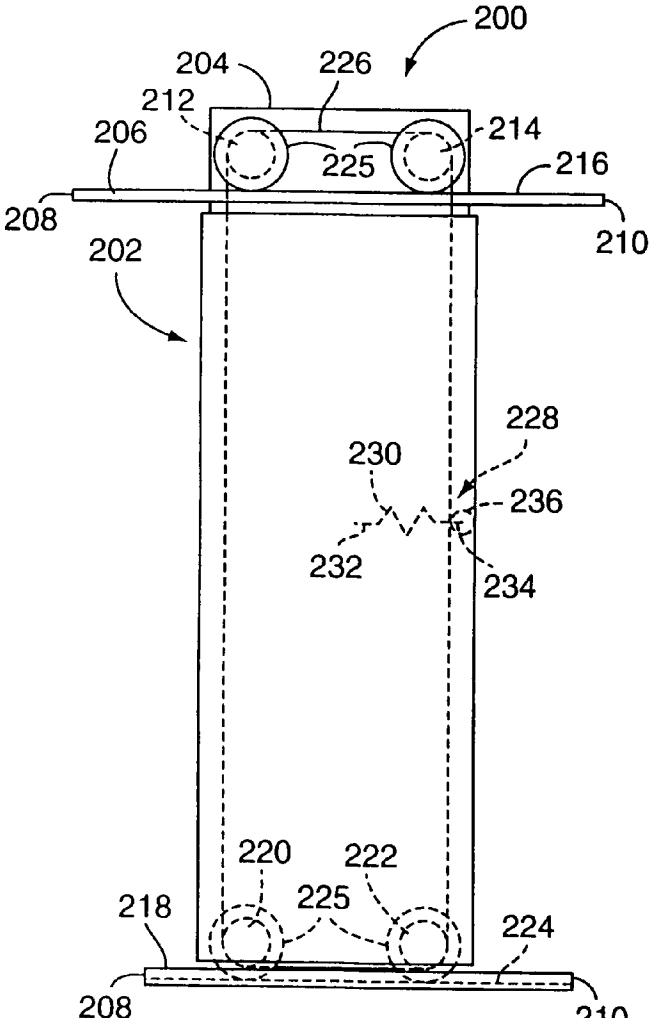
FIG. 5 is a schematic, elevational view of an elevator door system in accordance with a fourth embodiment of the present invention.

With reference to FIGS. 5 and 6, an elevator door system in accordance with a fourth embodiment of the present invention is generally designated by the reference number 200. For simplicity of illustration, the system 200 does not show the front face of the elevator car or the pulley system for assisting in the movement of the elevator doors, such as, for example, the pulley system of FIG. 1 which includes the first and second sheaves 36, 38, the fixations 56, 58 and the rope 40.

The door system 200 includes an elevator car (not shown) similar to that shown in the previous embodiments. At least one elevator door 202 includes a hanger 204 projecting upwardly from a body of the door for mounting the door to the elevator car over a door opening. The hanger 204 when mounted on the elevator car is spaced frontwardly of a front face of the elevator car. An upper, elongated member or upper roller track 206 is mounted on either a header bracket or directly to the front face of the elevator car below an upper edge or ceiling of the car and above the door opening. As shown in FIG. 5, the upper roller track 206 preferably extends generally from a first side 208 to a second side 210 of the elevator car. At least one roller, such as first and second rollers 212, 214, are attached to the hanger 204. The first and second rollers 212 and 214 rotatably engage a top edge 216 of the upper roller track 206 for supporting the elevator door 202 and assisting the pulley system in moving the elevator door from an open position to a closed position.

A lower, elongated member or lower roller track 218 is mounted on either a header bracket or directly to the front face of the elevator car above a lower edge or floor of the car and below the door opening. As shown in FIG. 5, the lower roller track 218 preferably extends generally from the first side 208 to the second side 210 of the elevator car. At least one roller, such as third and fourth rollers 220, 222, are attached to a bottom portion of the elevator door 202. The third and fourth rollers 220 and 222 rotatably engage a top edge 224 of the lower roller track 218 for further supporting the elevator door 202 and assisting the pulley system in moving the elevator door from an open position to a closed position.

At least one of the rollers 212, 214, 220, 222 is a motor roller, and is preferably an external rotor permanent magnet motor upon which the outside rim of the rotor receives a tire 225. The number of rollers which are motor rollers may increase for enhanced performance and reliability of the elevator door system 200 as was described in detail with respect to the embodiment of FIG. 3. Preferably, when one of the rollers 212, 214, 220, 222 is a motor roller and the remainder are passive or conventional rollers, the upper and lower rollers are rotatably coupled to each other via a rope 226 for a smooth transfer of the rotational movement of the motor roller among the remainder upper and lower rollers. As shown in FIG. 5, the rope 226 arcs about the first roller 212, extends generally horizontally and arcs about the second roller 214, extends generally vertically and arcs about the third roller 222, extends generally horizontally and arcs about the fourth roller 220 and extends generally vertically to the first roller 212 to form a closed loop. The rope 226 is preferably a synchronous belt or toothed belt to better synchronize the rotational movement of the rollers with one another. Preferably, the elevator system 200 includes tensioning means 228 for providing tension to the rope 226 to thereby ensure continuous transference of the rotational movement of the motor roller to the remaining rollers and to dampen any vibration of the rope. For example, the tensioning means may include a spring 230 in tension having a first end 232 fixed to the elevator door 202 and a second end 234 coupled to a pulley 236. The pulley 236 is rotatably engaged with the rope 226 along a portion of the rope disposed between the upper and lower rollers such that the spring 230 pulls the pulley, and in turn the rope toward the first end 232 of the spring in order to keep the rope taut. An advantage of the elevator door system 200 embodying the present invention is the modularity of the system when employing multiple door elevator cars because each door may have its own motor(s).

Figure 7:
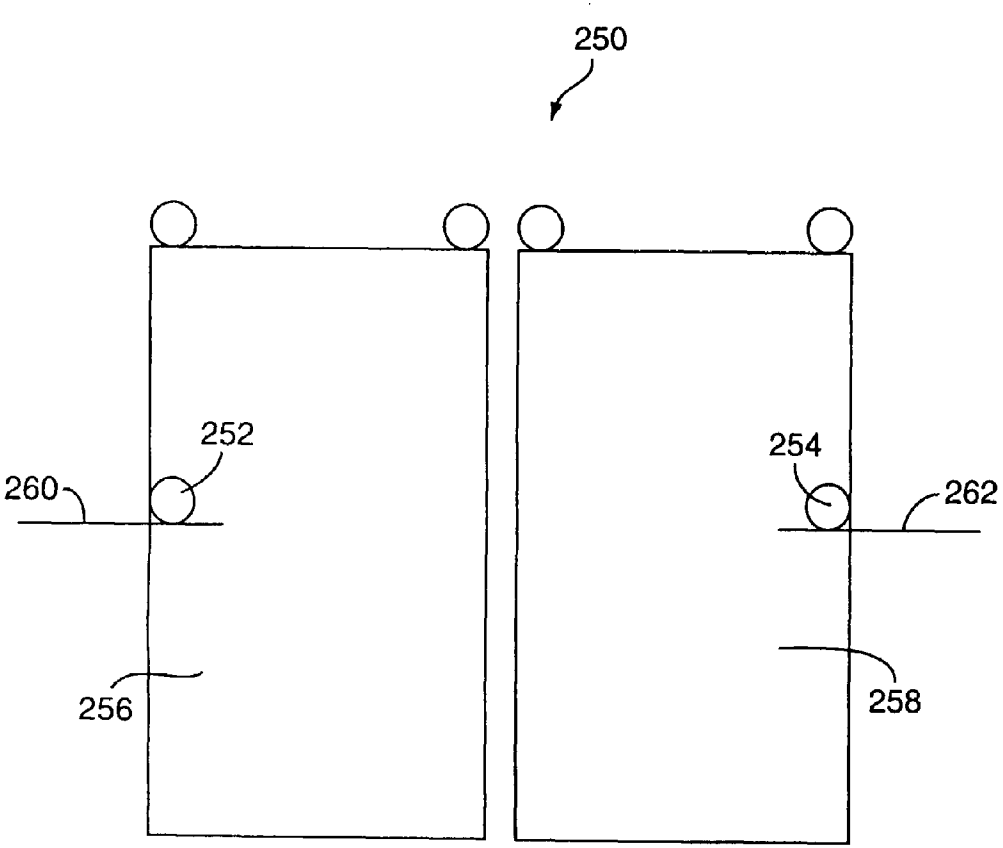
FIG. 7 is a simplified, schematic, elevational view of an elevator door system employing motor rollers mounted on elevator doors midway between the lower and upper edges of the doors.

FIG. 7 schematically illustrates in simplified form an elevator door system 250 that is similar to the elevator door system 200 of FIGS. 5 and 6 except that one or more motor rollers are provided at a center of an elevator door. For example, as shown in FIG. 7, roller motors 252, 254 are respectively coupled to elevator doors 256, 258 at a location on the doors about midway between upper and lower edges of the doors. Roller tracks 260, 262 are coupled to the front face of the elevator car on each side thereof to be respectively engaged by the rollers 252, 254. The roller tracks 260, 262 may require additional lateral space. Providing the roller motors 252, 254 avoids tilt-effects to the doors (i.e., the tendency of the doors to rotate) which may otherwise occur if the doors were only driven at the top or bottom portions.

Figure 8:
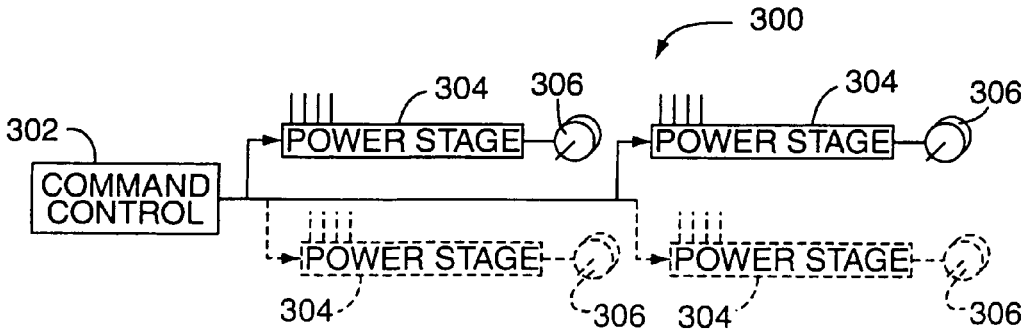
FIG. 8 schematically illustrates a controller circuit for powering the elevator door system of FIG. 6.

If the elevator system 200 of FIGS. 5 and 6 includes a plurality of motor rollers, the system may synchronize movement among the motor rollers by means other than the rope 226. As shown in FIG. 8, for example, a control system 300 employed for synchronizing the motors includes a conventional controller 302 coupled to a plurality of power stages 304, 304. Each power stage 304 is coupled to a corresponding motor roller 306. The controller 302 signals the power stages 304, 304 to actuate the motor rollers 306, 306 to move synchronously with one another. An advantage of having a power stage for each motor is that if a power stage or motor fails, the other motor rollers will continue to function.

Figure 9:
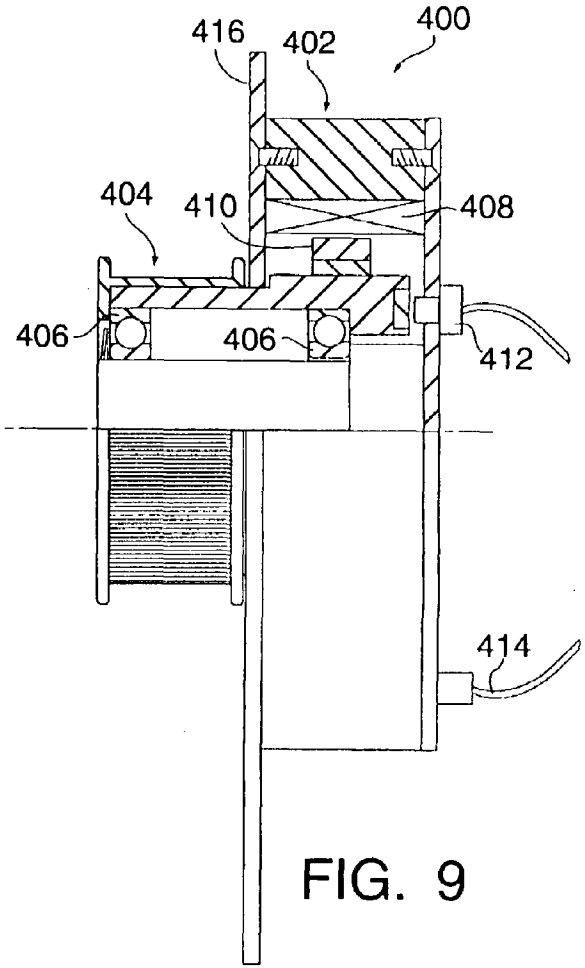
FIG. 9. is a side elevational view of a motor assembly including a ring torque motor disposed to a side of a drive sheave for driving elevator doors in accordance with the present invention.

The flat motor assemblies shown in the previous embodiments, which include either a sheave or roller, may be embodied in various ways, as shown in FIGS. 9–15B. For example, FIG. 9 illustrates a motor assembly 400 including a ring torque motor 402 drivingly engaged with and disposed to a side of a pulley or sheave 404. The sheave 404 is rotatably coupled to the ring torque motor 402 via ball bearings 406, 406. The ring torque motor 402 includes winding 408, at least one permanent magnet 410 for electromagnetically interacting with the winding 408 to rotate the sheave 404, a Hall effect encoder 412 for detecting the rotational position of the sheave 404, and a power cord 414 for supplying electrical power to the ring torque motor 402. A support plate 416 is generally interposed between the ring torque motor 402 and the sheave 404 for mounting the motor assembly 400 to an elevator car.

Figure 10B:
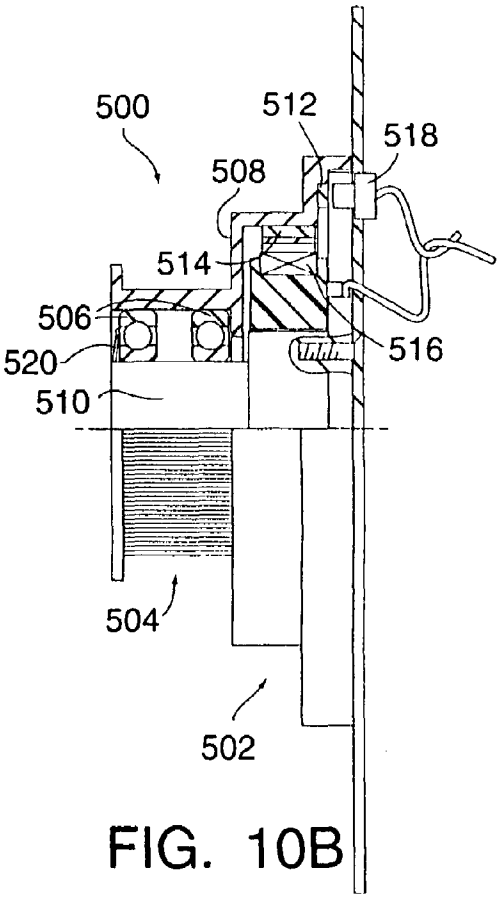
FIG. 10B is the assembled, side elevational view of the motor assembly of FIG. 1A.
Figure 10A:
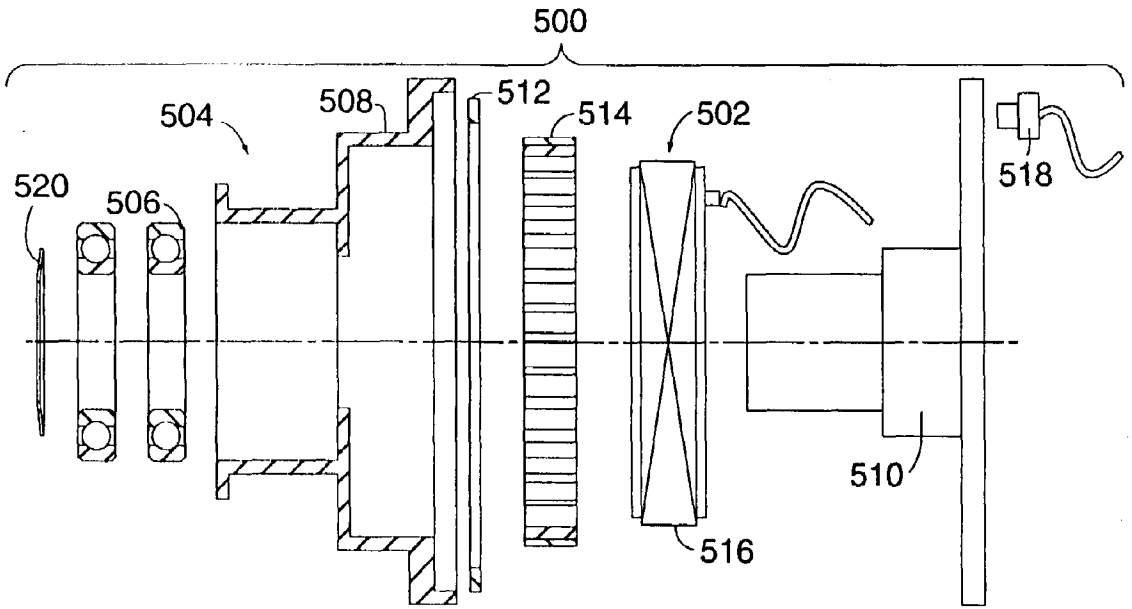
FIG. 10A is an exploded, side elevational view of a second motor assembly including a ring torque motor disposed to a side of a drive sheave for driving elevator doors in accordance with the present invention.

FIGS. 10A and 10B respectively show in exploded and assembled view a motor assembly 500 including a ring torque motor 502 drivingly engaged with and disposed to a side of a pulley or sheave 504. Annular ball bearing assemblies 506, 506 are disposed within a cover 508 to enable the cover to rotate relative to a motor support 510. A ring magnet 512 having axial poles is coupled to the cover 508. An annular magnet assembly 514 including a plurality of permanent magnets is also coupled to the cover 508. A winding 516 is coupled to the support 510 and is disposed within the magnet assembly 514 in order to electromagnetically interact with the magnet assembly for rotating the sheave 504 relative to the support 510. A Hall effect encoder 518 is coupled to the support 510 to sense the axial poles of past the encoder, and thereby determine the rotational position of the sheave 504 relative to the support 510. A pin 520 retains together the components of the motor assembly 500.

Figure 11:
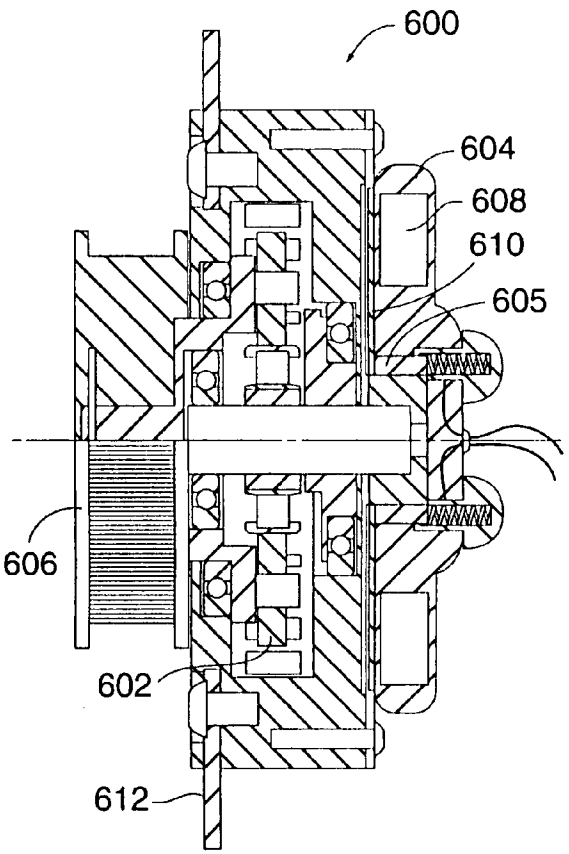
FIG. 11 is a side elevational view of a third motor assembly including a cycloidal-gear and disc motor disposed to a side of a drive sheave for driving elevator doors in accordance with the present invention.

FIG. 11 illustrates a motor assembly 600 including a cycloidal-gear 602 and disc motor 604 including a graphite brush 605 drivingly coupled to and disposed to a side of a sheave 606. The gear 602 serves to reduce the rpm of the sheave 606 relative to the rpm of the disc motor 604. An annular magnet assembly 608 opposes and electromagnetically interacts with disc winding 610 for rotating the sheave 606 relative to a support 612.

Figure 12B:
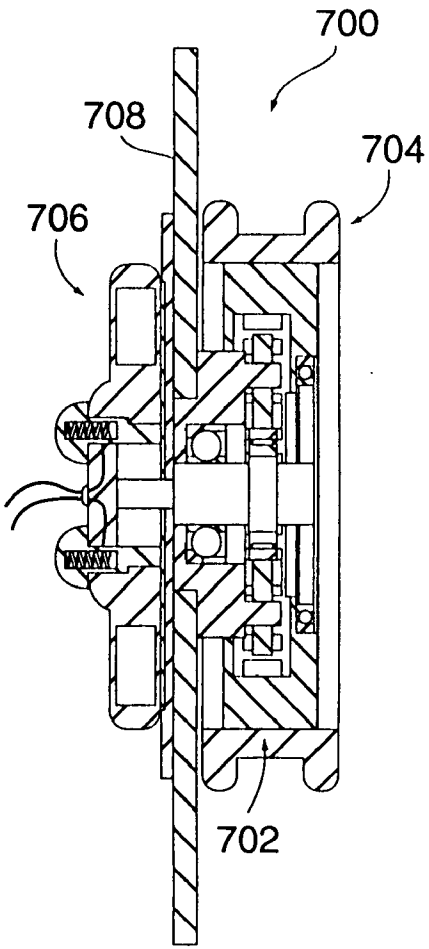
FIG. 12B is an assembled, side elevational view of the motor assembly of FIG. 12A.
Figure 12A:
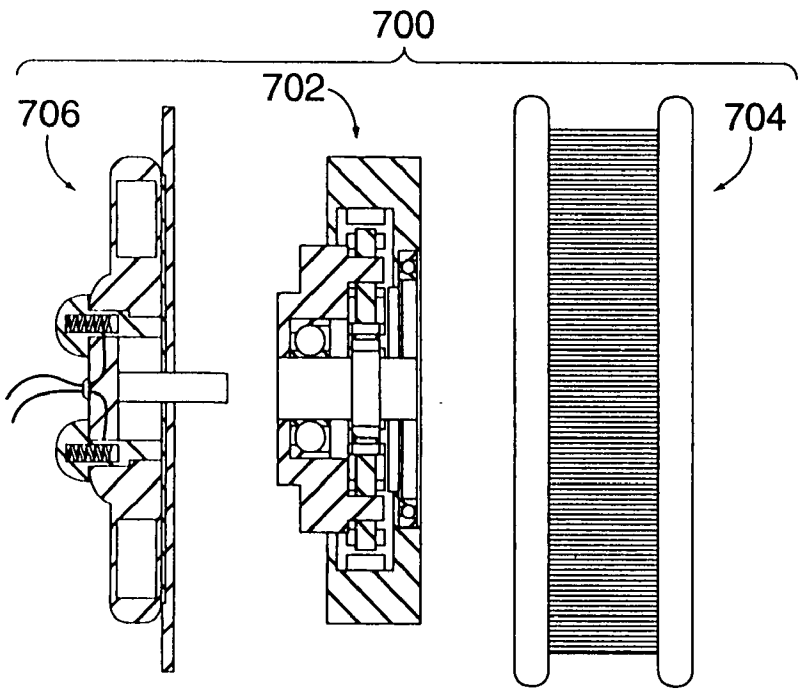
FIG. 12A is an exploded, side elevational view of a fourth motor assembly including a cycloidal-gear disposed inside a drive sheave and a disc motor disposed to a side of the drive sheave for driving elevator doors in accordance with the present invention.

FIGS. 12A and 12B respectively illustrate in exploded and assembled view a motor assembly 700 including a cycloidal-gear 702 disposed within a sheave 704, and a disc motor 706 disposed drivingly coupled to and disposed to a side of the sheave 704. The motor assembly 700 is mounted on a support 708 interposed generally between the disc motor 706 and both the cycloidal-gear 702 and the sheave 704.

Figure 13B:
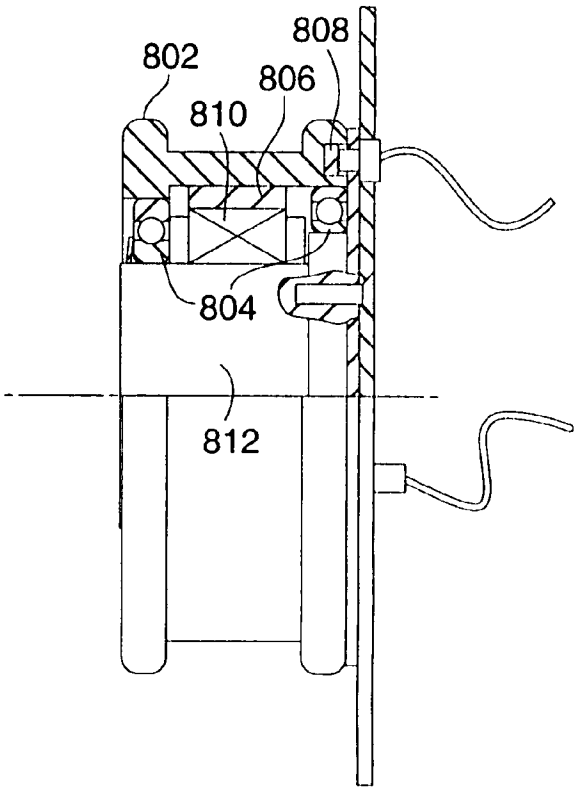
FIG. 13B is an assembled, side elevational view of the motor assembly of FIG. 13A.
Figure 13A:
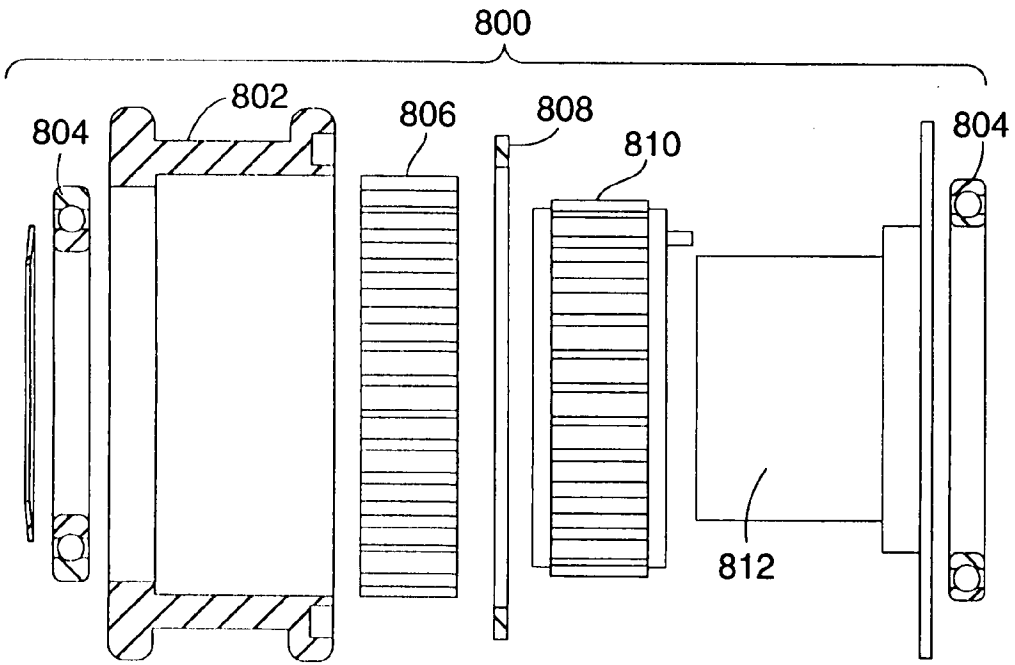
FIG. 13A is an exploded, side elevational view of a fifth motor assembly including a ring torque motor disposed inside a drive sheave for driving elevator doors in accordance with the present invention.

FIGS. 13A and 13B respectively show in exploded and assembled view a motor assembly 800 including a ring torque motor drivingly coupled to and disposed to a side of a sheave 802. The sheave 802 receives ball bearing assemblies 804, 804, an annular magnet assembly 806, a ring magnet 808 with axial poles, a winding 810 and support 812 to produce a flat motor assembly.

Figure 14B:
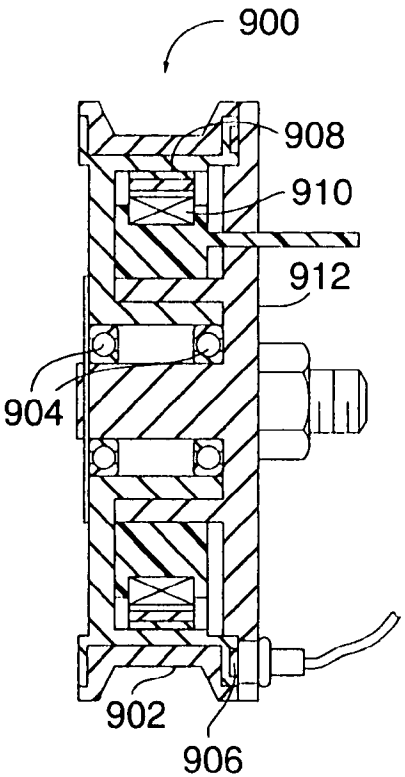
FIG. 14B is an assembled, side elevational view of the motor assembly of FIG. 14A.
Figure 14A:
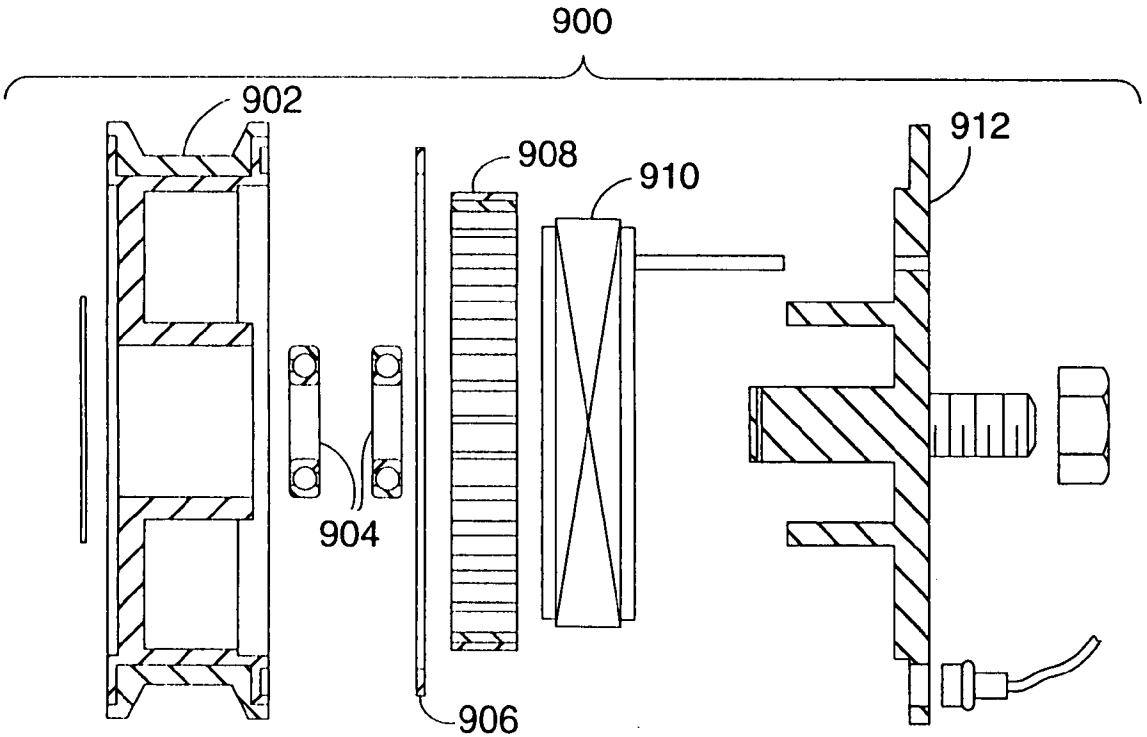
FIG. 14A is an exploded, side elevational view of a sixth motor assembly including a ring torque motor disposed inside a roller for driving elevator doors in accordance with the present invention.

FIGS. 14A and 14B respectively illustrate in exploded and assembled view a motor assembly 900 including a ring torque motor drivingly coupled to and disposed within a roller 902. Ball bearing assemblies 904, 904, ring magnet 906 with axial poles, annular magnet assembly 908, and winding/armature 910 and support 912 are inserted within the roller 902 to form a compact, flat motor assembly.

Figure 15B:
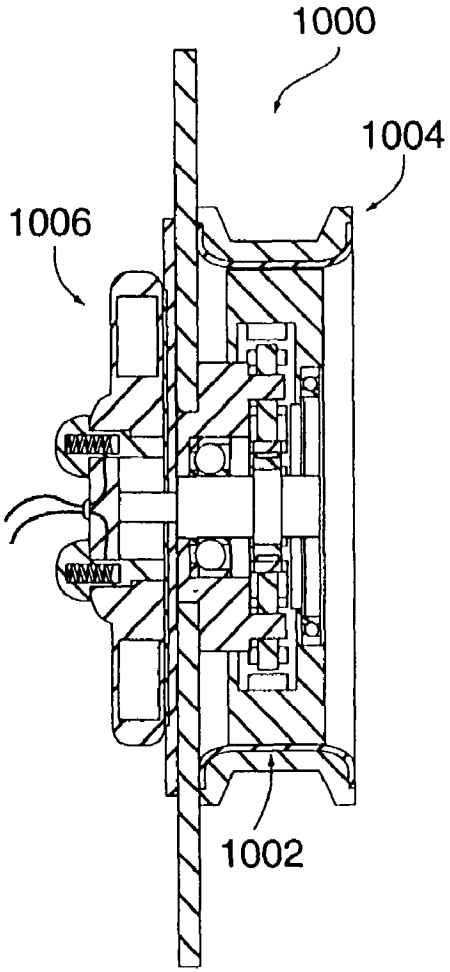
FIG. 15B. is an assembled, side elevational view of the motor assembly of FIG. 15A.
Figure 15A:
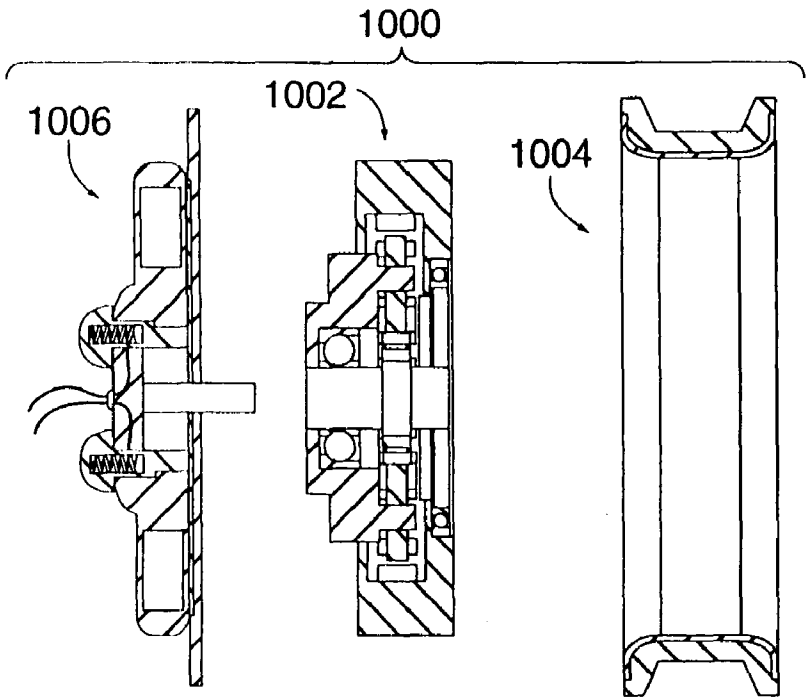
FIG. 15A is an exploded, side elevational view of a seventh motor assembly including a cycloidal-gear disposed inside a roller and a disc motor disposed to a side of the roller for driving elevator doors in accordance with the present invention.

FIGS. 15A and 15B respectively illustrate in exploded and assembled view a motor assembly 1000 including a cycloidal-gear 1002 disposed inside a roller 1004, and a disc motor 1006 drivingly coupled to and disposed to a side of the roller.

Although this invention has been shown and described with respect to several embodiments thereof, it should be understood by those skilled in the art that the foregoing and various other changes, omissions, and additions in the form and detail thereof may be made therein without departing from the spirit and scope of the invention. For example, the motor rollers may be coupled to a stationary surface of the elevator car for engagement with roller tracks coupled to the elevator door. Accordingly, the invention has been described and shown in several embodiments by way of illustration rather than limitation.

What is claimed is:

1. An elevator door system for an elevator car having a front face defining a door opening, the elevator door system comprising:

at least one elevator door coupled to the front face of the elevator car for movement between an open position exposing the door opening and a closed position covering the door opening;

a first sheave and second sheave disposed at the front face of the elevator car;

a belt forming a closed loop about the first and second sheaves wherein the door is in operable communication with the belt, at least one drive motor integrated onto one of the sheaves and disposed forwardly of the front face of the elevator car such that the drive motor is drivingly coupled to the belt for moving the elevator door between the open and closed positions; and the drive motor having an axis of rotation perpendicular to a plane of the elevator door.

2. An elevator door system as defined in claim 1, wherein the drive motor is a permanent magnet motor.

3. An elevator door system as defined in claim 1, wherein the drive motor is a motor assembly including a ring torque motor.

4. An elevator door system as defined in claim 1, wherein the drive motor is a motor assembly including a cycloidal-gear and disc motor.

5. An elevator door system as defined in claim 1, wherein the drive motor is sized and mounted to the front face of the elevator car so as to not intrude into a hoistway space above or below the elevator car.

6. An elevator door system as defined in claim 1, wherein the belt is a single toothed belt.

7. An elevator door system as defined in claim 1, wherein the drive motor includes a rotor and the rotor serves as the first sheave.

8. An elevator door system as defined in claim 1, wherein the drive motor is drivingly coupled to and disposed to a side of the first sheave.

9. An elevator door system as defined in claim 1, wherein the drive motor is flat.

10. An elevator door system as defined in claim 1, wherein the elevator car includes a header bracket mounted to the elevator car and the drive motor is mounted to the header bracket.

11. An elevator door system as defined in claim 10, wherein the header bracket is disposed generally above the door opening.

12. An elevator door system as defined in claim 10, wherein the header bracket is extends below the upper edge of the elevator car.

13. An elevator door system as defined in claim 10, wherein the header bracket extends generally between first and second sides of the elevator car.

14. An elevator door system as defined in claim 10, wherein the header bracket further includes a roller track that extends along a length of the header bracket.

15. An elevator door system as defined in claim 14, further comprising at least one roller engaged with the roller track and inoperable communication with the at least one elevator door.

16. An elevator door system as defined in claim 15, wherein the at least one elevator door includes a hanger and the roller is coupled to the hanger.

17. An elevator door system defined in claim 1, wherein the drive motor is mounted on the front face of the elevator car and disposed between a lower edge and an upper edge of the elevator car.

18. An elevator door system as defined in claim 17, and further including a header bracket mounted on the front thee of the elevator car between the lower edge and the upper edge of the elevator car, and wherein the at least one elevator door includes a hanger spaced frontwardly of the front face of the elevator car, and the drive motor is disposed rearwardly of the hanger.

19. An elevator door system as defined in claim 1, wherein the header bracket is disposed below the upper edge of the elevator car and generally above the door opening, the header bracket extending generally between first and second sides of the elevator car, and wherein the drive motor is mounted on the header bracket.

20. An elevator door system as defined in claim 1, wherein the drive motor is disposed generally adjacent to a first side of the elevator car.

21. An elevator door system as defined in claim 1 wherein the belt defines upper and lower portions each extending between the first and second sheaves, and further comprising another door attached to the belt, one door attached to upper portion of the belt, and the other door attached to a lower portion of the belt such that the doors move in opposite directions relative to one another as the drive motor moves the belt about a portion of the closed loop.

* * * * *